United States Patent [19]

Waldrum

[11] 4,231,520

[45] Nov. 4, 1980

[54] LIQUID SPRAYER

[76] Inventor: John E. Waldrum, 349 Fairview Ave., Ambler, Pa. 19002

[21] Appl. No.: 17,078

[22] Filed: Mar. 2, 1979

[51] Int. Cl.[3] ..... B05B 1/14; B05B 1/32

[52] U.S. Cl. ..... 239/171; 239/533.13; 239/562; 239/571; 138/45

[58] Field of Search ..... 239/171, 533.1, 533.13, 239/533.15, 562, 570, 571, 572; 138/45, 46

[56] References Cited

U.S. PATENT DOCUMENTS

| | | | |
|---|---|---|---|
| 2,721,102 | 10/1955 | Nissen | 239/171 |
| 2,783,083 | 2/1957 | Canter | 138/45 X |
| 2,950,061 | 8/1960 | Dickinson | 239/570 X |
| 3,445,065 | 5/1969 | Waldrum . | |
| 3,523,646 | 8/1970 | Waldrum . | |
| 3,550,854 | 12/1970 | Fischer | 239/155 |
| 3,762,649 | 10/1973 | Dalhaus | 239/171 X |
| 4,036,435 | 7/1977 | Pecaro | 239/570 X |
| 4,075,294 | 2/1978 | Saito et al. | 138/45 X |

FOREIGN PATENT DOCUMENTS

| | | | |
|---|---|---|---|
| 703612 | 2/1954 | United Kingdom | 239/171 |

*Primary Examiner*—Robert W. Saifer
*Attorney, Agent, or Firm*—Dale L. Carlson

[57] ABSTRACT

A spray device for spraying liquid from a moving vehicle in a controlled spray pattern involves a central body; a conduit defined in the body which forms a liquid inlet port at one end of the body; a plurality of outlet ports located about the periphery of the conduit; a plurality of discharge tubes extending outwardly from said central body, each of said discharge tubes having one end connected to one of said outlet ports and the other end projecting in a direction opposite the direction of movement of the vehicle during use; and moveable, pressure-actuated outlet-blocking means. In one embodiment there is additionally provided means for controlling the rate of flow of liquid through the device.

There is also disclosed an apparatus for spraying liquid from a moving vehicle in a variable swath width.

6 Claims, 8 Drawing Figures

Fig.1.
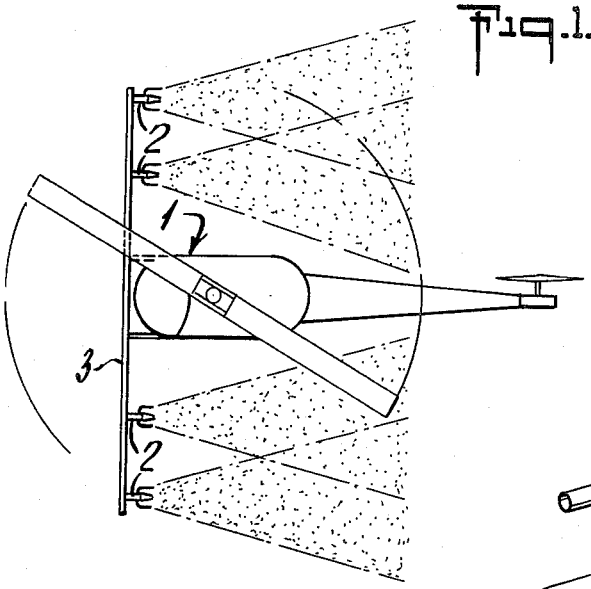
Fig.2.
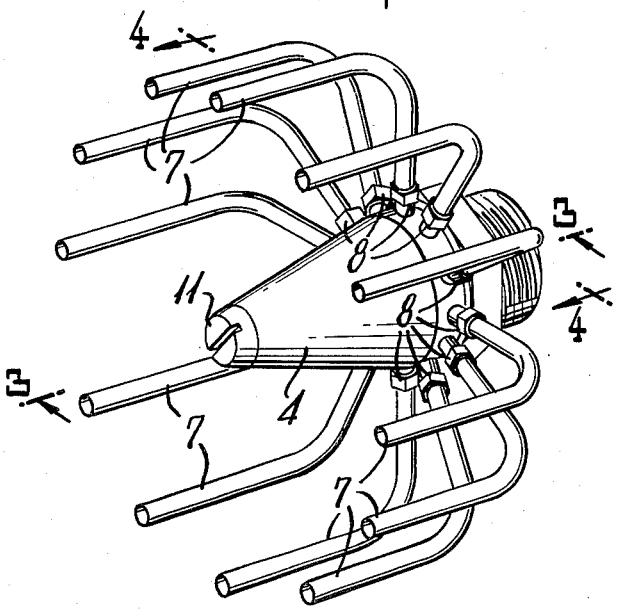
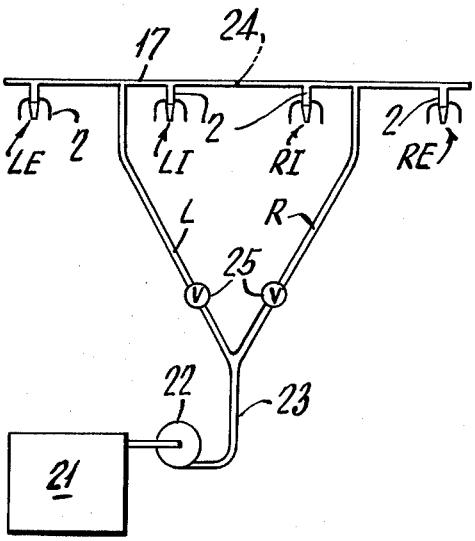
Fig.8.
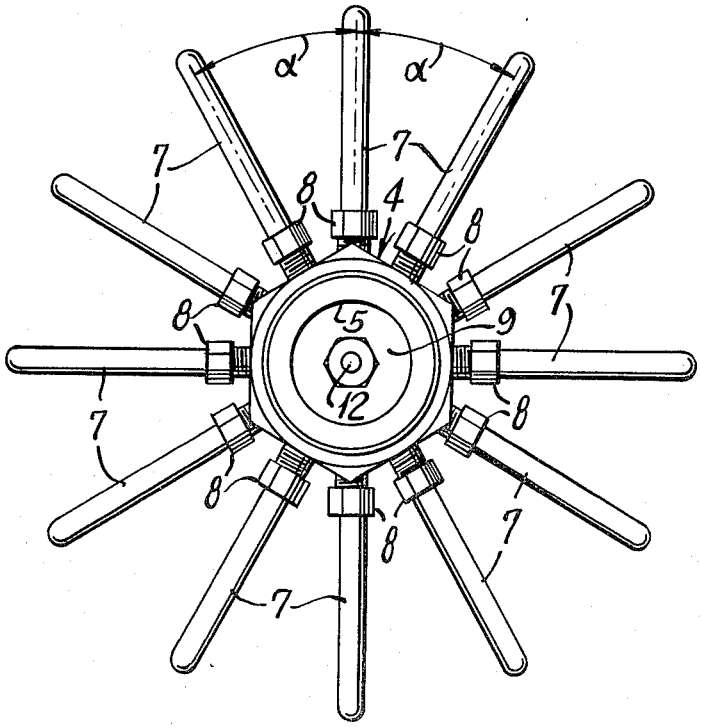
Fig.4.

LIQUID SPRAYER

BACKGROUND OF THE INVENTION

This invention relates to methods and apparatus for spraying fluids, e.g. liquids such as herbicides and pesticides, from a moving vehicle. More particularly, the invention relates to a spray device for spraying liquids from a moving aircraft in a manner which allows the operator to carefully control the spray pattern and to minimize undesired drift. If desired, the spray device can be adapted for use with land equipment. The spray device has the virtue of requiring only very simple maintenance. The invention further relates to a method of varying the swath width of a spray pattern during a spraying operation without the need for a complicated system of shutoff valves.

The problem of drift during the spraying of herbicides and pesticides is well known and is discussed in my U.S. Pat. Nos. 3,445,065 and 3,523,646. The term "drift" refers to the displacement of a portion of the spray from its intended spray pattern into undesired areas. Drift is generally caused by unpredictable winds, drafts, air turbulence, etc. Minimization of drift is a major objective in spraying operations. The powerful properties of a systemic herbicide are such that a few drops of the systemic herbicide are sufficient to kill a plant. While systemic herbicides are selective, such herbicides will attack certain economic crops, therefore, they must be applied in a carefully controlled manner. Likewise, untoward results can ensue if systemic insecticides drift into areas where it is not intended to apply them.

As discussed in the previously mentioned U.S. patents, the problem of drift is particularly acute when fine droplets are present in the spray. Generally, droplets of less than about 300 microns in diameter are considered to be undesirable from the point of view of being subject to drift. To control drift it is considered highly desirable to have spray devices which produce droplets of substantially uniform size.

U.S. Pat. Nos. 3,445,065 and 3,523,646 describe means of spraying liquids in such a manner that undesired drift is minimized.

It is disclosed in the previously mentioned patents that the problem of drift can be minimized by discharging the liquid in a laminar stream from a spray nozzle while the nozzle is moving in a direction substantially opposite the direction of spray discharge. By discharging the stream in a direction opposite the direction of movement of the nozzle the formation of small "satellite" droplets is prevented. These satellite droplets, which are formed when liquid is discharged in a laminar flow from a stationary nozzle, tend to be subject to drift in cross winds and the like.

Several spray devices are disclosed in U.S. Pat. Nos. 3,445,065 and 3,523,646 for spraying liquids in a manner which minimizes drift. All of these devices employ a series of discharge tubes which are pointed in a direction opposite the direction of movement of the nozzle during use.

All of these devices further employ some mechanism for preventing drippage from the nozzles upon shut off of the liquid supply. In one embodiment disclosed in U.S. Pat. No. 3,445,065, each of the individual discharge tubes contains a small valve which closes upon cessation of liquid pressure. Unfortunately, the large number of such valves and the small diameter of the discharge tubes creates maintenance problems, which are particularly troublesome when the device is employed in remote agricultural areas where skilled mechanics are not readily available. The numerous small valves require regular maintenance to remain in good working order. Moreover, they are relatively easily clogged by contaminants or when attempting to spray liquids which contain suspended solids.

In another embodiment, U.S. Pat. No. 3,445,065 discloses a spray device in which the discharge tubes emanate from a hollow body of airfoil configuration which contains an absorbent material such as a sponge. U.S. Pat. No. 3,523,646 discloses a similar device in which each of the discharge tubes is in fluid communication with the absorbent material by means of a capillary tube. The use of the capillary tube prevents drippage when positive pressure is removed from the liquid in the absorbent material. These capillary tubes also require periodic maintenance to ensure that they are kept clear and they are subject to clogging by contaminants or suspended solids. Likewise, the absorbent material can become contaminated and it prevents the use of liquids containing suspended solids. A further problem with this type of device is that the hollow body containing the absorbent material is a relatively large body which is located in front of the discharge tubes as the vehicle moves forward. Consequently, it can create air turbulence which is capable of breaking up the spray pattern and causing the formation of non-uniform droplet sizes which result in drift. While the hollow body is generally of an airfoil configuration to reduce turbulence, it is necessary for the operator to make frequent adjustments to the angle of the airfoil as the attitude of the vehicle (e.g. a helicopter) changes in order to keep the airfoil "in trim." When the spray device is employed on an aircraft, the presence of the hollow body in front of the discharge tubes represents a limiting factor of the maximum airspeed at which the device can be operated with reasonable assurance that air turbulence will not break up the spray and cause drift.

Another problem which exists with spray devices known in the prior art is that they generally employ discharge tubes which are arranged along a boom which is affixed to the vehicle so that the tubes are in an essentially planar configuration. The resultant spray discharge thus forms a "blanket" of spray. As this blanket settles to the ground it has the ability to compress a certain amount of air beneath it. Upon nearing the ground this compressed air is forced to move laterally, creating ground turbulence which can displace the spray laterally from its target area.

Frequently, it is desired to vary the swath width of the area being sprayed while the vehicle is in motion. For example, when spraying herbicides from an aircraft to control vegetation along a power line right-of-way, it is not uncommon for the right-of-way to suddenly narrow or widen on one or both sides. In order to allow the pilot to shut off spray nozzles on the end sections of the boom, it has been necessary to have a series of shutoff valves and associated controls in the liquid supply boom. This further complicates maintenance procedures and adds weight to the boom. Even a small amount of additional weight on the boom, which is cantilevered from the aircraft, is considered undesirable.

It is an object of the present invention to provide a spray device which will spray liquids, such as herbicides and insecticides, in droplets of essentially uniform size from a moving vehicle, such as a helicopter or airplane, so as to minimize the problem of drift.

It is another object of the invention to provide such a spray device which is constructed in such a way that it requires only very simple maintenance to keep it in good operating condition. It is a further object that the spray device should not easily become clogged by contamination and should be capable of spraying liquids containing suspended or dispersed solids without clogging.

It is another object of the invention to provide a spray device which can be operated from an aircraft at relatively high speeds without substantial loss of droplet uniformity or drift control. Moreover, it is an object to provide a spray device which can be operated from an aircraft without the need for frequent critical trim adjustments by the pilot to control the spray pattern.

It is another object of this invention to minimize the problem of ground turbulence which displaces a spray from its intended target area.

It is yet another object of the invention to provide an apparatus for spraying a fluid from a moving vehicle which allows the operator to vary the swath width of the spray pattern while the vehicle is in motion without the need for a complicated series of shutoff valves.

Other objects and advantages of the present invention will be apparent to the skilled worker in the art from the description that follows.

SUMMARY OF THE INVENTION

The objects of the invention are achieved by providing a spray device in the form of a central body which has an inlet port at one end through which liquid flows under pressure into a conduit which is defined within the central body. A plurality of outlet ports are arranged about the periphery of the conduit and a plurality of discharge tubes, each connected at one end to one of the outlet ports, extend outwardly from the central body. The other end of each discharge tube projects in the direction opposite the direction of movement of the vehicle to which the device is affixed during use, thus allowing the formation of droplets of uniform size by discharging liquid from the discharge tubes in a laminar flow in the direction opposite the direction of movement of the vehicle.

The spray device of this invention is characterized by moveable, pressure-actuated outlet-blocking means positioned in the conduit. The outlet-blocking means are positioned to interrupt the flow of fluid from the conduit into the outlet ports when the liquid pressure in the conduit is below a predetermined actuating pressure. When the liquid pressure in the conduit exceeds the predetermined actuating pressure, the outlet-blocking means moves into a non-blocking position, thus allowing liquid to flow from the conduit into the outlet ports and thence through the discharge tubes.

In a preferred embodiment of the invention, the outlet-blocking means comprises a piston which is positioned in the conduit and which is moveable from the outlet-blocking position to a non-blocking position by the action of liquid pressure in the conduit against the piston. There is also provided a means for exerting an opposing force against the piston—preferably a spring located in the conduit—which forces the piston back into the outlet-blocking position, thus stopping the flow of liquid through the discharge tubes, whenever the liquid pressure in the conduit drops below the actuating pressure.

By having a single means for shutting off the flow to a plurality of discharge tubes, rather than numerous valves located within the individual discharge tubes, maintenance is greatly simplified. Moreover, since the conduit which contains the shutoff means is considerably larger in cross-sectional area than the discharge tubes or the capillary tubes employed in the prior art, the likelihood of the device becoming clogged is greatly reduced and it is possible to spray liquids containing suspended or dispersed solids without clogging.

In another embodiment the spray device of this invention is provided with a flow rate controlling mechanism which comprises a moveable means for obstructing a portion of the cross-sectional area of the inlet port. The movement of the inlet port obstructing means is coordinated with the pressure-actuated movement of the piston in the conduit so that increased liquid pressure in the conduit results in obstruction of an increased cross-sectional area of the inlet port, thus presenting a smaller available cross-sectional area for flow through the inlet port. Conversely, a reduction in liquid pressure in the conduit results in a reduction in the cross-sectional area of the inlet port which is obstructed, thus presenting a greater cross-sectional area for liquid flow through the inlet port.

The means for obstructing a cross-sectional portion of the inlet port can be coordinated with the movement of the piston such that the inlet port is completely obstructed whenever the liquid pressure in the conduit exceeds a predetermined maximum operating pressure. There is thus provided a spray device which is operational for spraying only when the liquid is provided to the sprayer at a pressure which is between the actuating pressure and the maximum operating pressure. If desired, the movement of the inlet port obstructing means can be coordinated with the pressure-actuated movement of the piston in the conduit so that an increase in liquid pressure in the conduit is accompanied by a compensating increase in the cross-sectional area of the inlet port which is obstructed, thereby providing a spray device which is self-regulating to provide a constant liquid flow rate, regardless of pressure, between the actuating pressure and maximum operating pressure.

The aforedescribed spray device having an actuating pressure and a maximum operating pressure can be employed as a component of an apparatus for spraying a variable swath width from a moving vehicle, without the use of complicated shutoff valves. A plurality of such spray devices, each having a different actuating pressure and/or maximum operating pressure are affixed to the vehicle in progressively increasing lateral distances from the vehicle. For example, a plurality of such devices can be deployed along a boom suspended from a helicopter. There is also provided means for supplying liquid under pressure to the spray devices, such as a pump located in the vehicle and associated piping and fittings. Further, there is provided means for controlling the pressure at which the liquid is supplied to the spray devices. The operator can control which spray devices are operational (i.e. spraying) and which are not at any given instant by varying the pressure at which the liquid is supplied. This, in turn, allows the operator to control the swath width merely by adjusting the pressure.

BRIEF DESCRIPTION OF THE DRAWINGS

FIG. 1 is a plan view of a helicopter equipped with spray devices of this invention in operation.

FIG. 2 is a perspective drawing of an embodiment of the spray device of this invention which does not incorporate the flow control mechanism of FIG. 5.

FIG. 4 is a back view of a spray device taken along lines 4—4 of FIG. 2 looking through the inlet port.

DETAILED DESCRIPTION AND PREFERRED EMBODIMENTS

Figure 3:
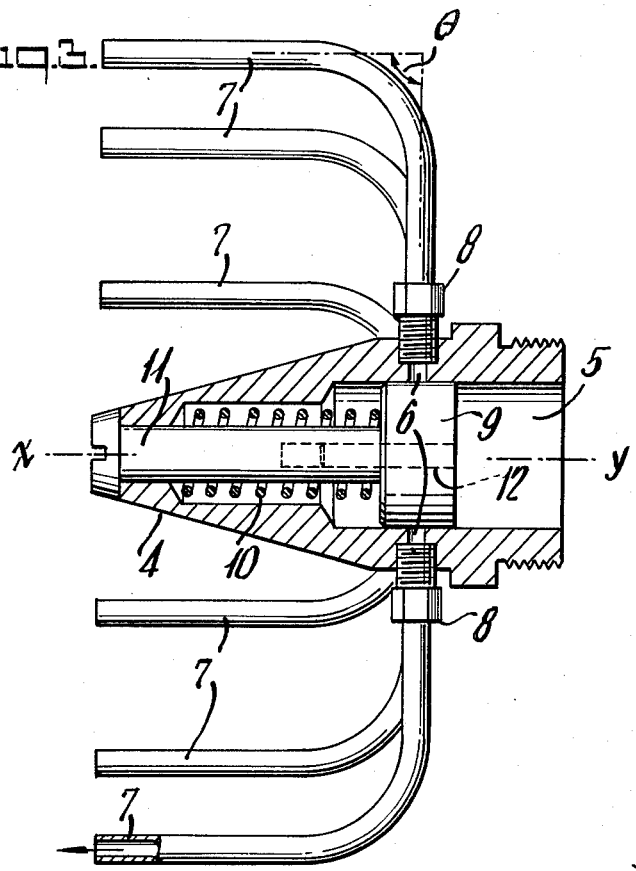
FIG. 3 is a cross sectional view of a spray device taken along lines 3—3 of FIG. 2.

Referring to the drawings, in which like reference characters refer to like parts, there is shown in FIG. 1 a plan view of a helicopter 1 equipped with a plurality of spray devices 2 of this invention. The spray devices 2 are deployed along a boom 3 which is affixed to the helicopter 1.

FIGS. 2 and 3 show a first preferred embodiment of the spray device which does not employ the flow rate controller hereinafter described. As shown in the figures, the spray device basically comprises a central body 4 having a conduit 5 defined therein, which conduit 5 forms a liquid inlet port at one end; a plurality of liquid outlet ports 6 located about the periphery of the conduit 5; and a plurality of liquid discharge tubes 7 emanating outwardly from the central body 4. One end of each discharge tube 7 is connected to one of the liquid outlet ports 6 by means of suitable fittings 8 which are threaded into mating threads in the outlet ports 6 and the other end projects in a direction essentially opposite the direction of movement of the vehicle to which the spray device is affixed during use. A piston 9 is positioned in the conduit 5 as a preferred embodiment of the moveable, pressure-actuated outlet-blocking means. The piston 9 is shown in FIG. 3 in the outlet blocking position. The piston 9 is preferably cylindrical in configuration and the conduit 5 is preferably cylindrical in configuration for at least that portion of its length along which the piston 9 travels in moving from the outlet blocking position to the non-blocking position. The common axis of the cylindrical piston 9 and cylindrical conduit 5 is defined by the line x-y, which is essentially parallel to the direction of movement of the vehicle during use. A spring 10 is positioned in the conduit 5 as a preferred means of exerting an opposing force against the piston 9. Also shown in FIG. 3 is a retaining pin 11 which extends through the wall of the central body 4 from the end opposite the inlet port and into the conduit 5 wherein it is affixed to the piston 9 by means of a connecting screw 12. The retaining pin may be employed, if desired, to prevent the spring 10 from forcing the piston 9 out through the liquid inlet port when there is no liquid pressure in the conduit 5, such as when the device is being removed for maintenance.

Preferably, the central body 4 is generally elongate in configuration along the axis of the conduit 5 and the surface thereof is tapered in configuration to minimize air turbulence in the vicinity of liquid discharge.

It is preferred that the discharge tubes 7 emanate radially from the central body 4; that is, they emanate in a manner such that the end section of each discharge tube 7 nearest its connection with the liquid outlet port 6 extends along a line which is radial from the cylindrical axis of the conduit 5. The middle section of each discharge tube 7 is curved through an angle $\theta$, such that the other end section projects along a line essentially parallel to the cylindrical axis of the conduit 5 and in a direction essentially opposite the direction of movement of the vehicle during use. Most preferably, the discharge tubes 7 radiate in such a manner that they are equally spaced about the central body 4; that is, with reference to FIG. 4, the angle $\alpha$ which separates each discharge tube 7 from the adjacent discharge tube is equal for all discharge tubes 7.

In operation, liquid under pressure flows into the conduit 5 from a suitable means of supply such as a liquid reservoir and pump (not shown), located in the vehicle, and associated piping. As shown in the figures, the end portion of the central body nearest the inlet port is threaded on its surface to allow connection with the supply means by a suitable threaded fitting. When the liquid pressure in the conduit 5 exceeds a predetermined actuating pressure, the piston 9 is forced to move against the opposing force exerted by the spring 10 until the outlet ports 6 are in fluid communication with the conduit 5, thus allowing the liquid to flow through the discharge tubes 7. Those skilled in the art will appreciate that the position of the spring 10 in the conduit 5 and the spring constant (i.e. the stiffness of the spring) can be selected to provide any desired actuating pressure.

It is preferred that the angle $\theta$ be slightly greater than 90°, most preferably between 90° and 91° so that the laminar streams emerging from the discharge tubes 7 diverge to form a spray pattern which overlaps the pattern of adjacent spray devices affixed to the vehicle, as shown in FIG. 1. Moreover, by causing the streams to diverge in all directions, the spray pattern achieved is three dimensional rather than the essentially planar pattern of prior art devices. This largely eliminates the problem of compression of air beneath the spray and the associated ground turbulence.

Figure 5:
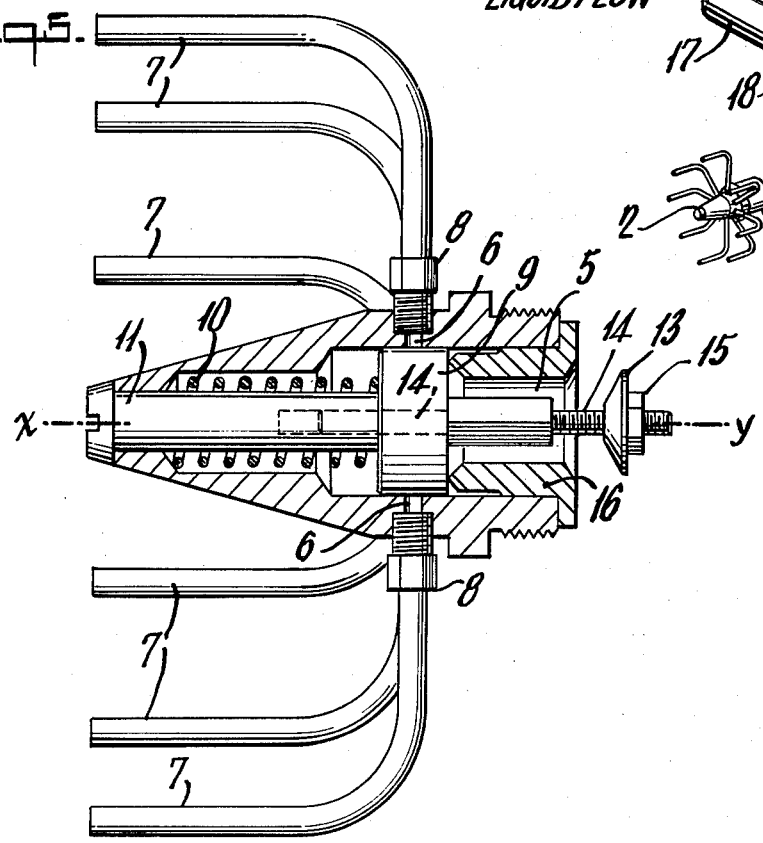
FIG. 5 is a cross sectional view of a spray device of this invention which incorporates a flow rate control mechanism.

FIG. 5 shows another preferred embodiment of the spray device of this invention, which is similar to the device of FIG. 3 except that there is additionally provided means for controlling the rate of flow of liquid therethrough. A conical body 13 is positioned in proximal relationship to the inlet port with the apex projecting toward the inlet port. The conical body 13 is affixed to the piston 9 by means of a connecting rod 14. The connecting rod 14 is threaded at either end to mate with female threads on the conical body 13 and the piston 9. The threaded end of the connecting rod 14 which passes through the piston also threads into the retaining pin 11 to attach it to the piston 9.

As increasing liquid pressure in the conduit 5 forces the piston 9 to move forward against the opposing force of the spring 10, the conical body 13 moves into the inlet port obstructing an increasing cross-sectional area of the inlet port, thereby reducing the area through which liquid can flow into the conduit. Conversely, when the liquid pressure is reduced, a greater cross-sectional area of the inlet port is available for liquid flow.

The positional relationship between the conical body 13 and the inlet port is adjustable by advancing the conical body 13 along the threads of the connecting rod 14. A retaining nut 15 maintains the position of the conical body 13. The conical body 13 can be positioned such that, when the liquid pressure in the conduit 5 exceeds the predetermined maximum operating pressure, the entire inlet port is obstructed. A bevelled sealing seat 16 is normally inserted in the inlet port to provide a seal with the conical body 13 when the maximum operating pressure is exceeded. The conical body 13 can be positioned such that increases or decreases in liquid pressure are accompanied by compensating increases or decreases in the cross-sectional area of the inlet port which is obstructed, thereby providing a constant rate of flow at any pressure between the actuating pressure and maximum operating pressure.

Figure 6:
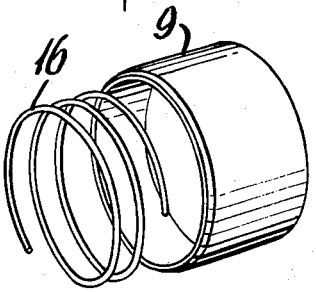
FIG. 6 is a perspective view of a preferred embodiment of a piston employed in the spray device in which a diametrically expandable spring is shown removed from the piston.

FIG. 6 is a perspective view of a preferred embodiment of the piston 9. As shown, the piston is generally cylindrical and is hollowed out along a portion of its length along the axis to form an annular section. A diametrically expandable spring 16 is securely positioned inside the annular section of the piston 9 so that the expansion bias of the spring exerts an outward force on the annulus walls, causing a liquid seal to be maintained between the piston 9 and the wall of the conduit 5. Preferably, the piston is constructed of a polymeric material which is capable of undergoing cold flow under stress so that, as the piston 9 becomes worn by friction it flows outward under the stress induced by the spring 16 to maintain the seal. Polytetrafluoroethylene is a highly preferred polymeric material both because it is capable of undergoing cold flow under stress and it minimizes friction.

The spray device of this invention, as illustrated in the figures, is a highly compact and relatively lightweight device, since numerous discharge tubes 7 radiate from a single relatively small central body 4. By comparison, prior art spray devices generally require discharge tubes emanating directly from some sort of boom. This is disadvantageous insofar as the supply boom being in close proximity to the liquid discharge creates "boom turbulence" which can adversely affect the formation of spray droplets.

Figure 7:
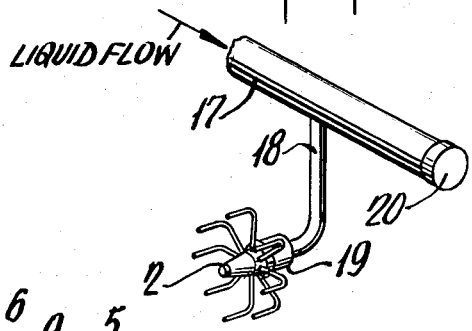
FIG. 7 is a perspective view showing a spray device of this invention affixed to a supply boom (partially shown) by means of a drop tube.

The problem of boom turbulence can be minimized in accordance with my invention by locating the spray device remotely from any supply boom. This can be achieved by affixing the spray device to a "drop tube" which is in turn connected to the source of liquid supply. The drop tube may originate from a supply boom or it may originate from the vehicle itself. FIG. 7 shows an enlarged section of a hollow supply boom 17 having a drop tube 18 extending downwardly therefrom and connected to the spray device 2 by means of a suitable threaded fitting 19. The supply boom 17 is affixed to the vehicle (not shown), on one or both sides of the vehicle such as is shown in FIG. 1. A plurality of spray devices are affixed to the boom 17, in the manner shown in FIG. 7, at periodic intervals along the boom 17. The boom 17 is connected to the source of supply of the liquid. Liquid flows under pressure through the boom 17, thence downward into the drop tube 18, through the inlet port and into the conduit 5 of the spray device. As shown, the boom 17 terminates in an end cap 20.

The drop tube 18 preferably has a relatively small diameter in relation to the boom 17. The streamlined configuration of the spray device and the ability to locate it remotely from supply booms, thereby minimizing boom turbulence, eliminates the necessity of highly critical trim adjustments during operation and allows uniform droplets and spray patterns to be formed at higher operating speeds.

Figure 8:
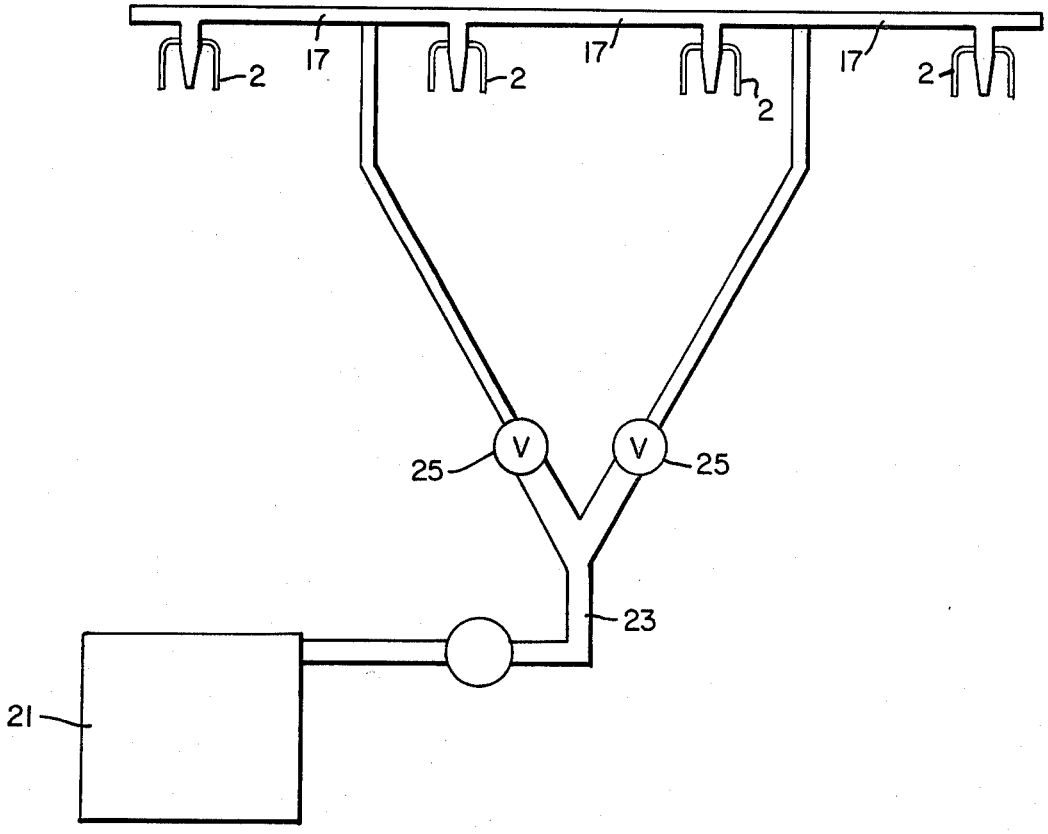
FIG. 8 is a schematic diagram of an apparatus for spraying a variable swath width from a moving vehicle.

Using the spray device of this invention equipped with flow rate control means, as illustrated in FIG. 5, there is provided an apparatus for spraying a variable swath width from a moving vehicle. An embodiment of the apparatus is represented schematically in FIG. 8. A plurality of spray devices 2 are affixed to a boom 17 at progressively increasing lateral distances from the center of the vehicle (vehicle not shown). The means for supplying liquid under pressure to the spray devices comprises a liquid reservoir 21 and pump 22, which can be located in the vehicle, supply lines 23 for carrying liquid from the pump to the boom 17, and drop tubes (not shown), if employed, for carrying liquid from the boom 17 to the spray devices 2.

The boom 17 is divided into two sections by a center blocking wall 24, however, this need not be the case and one skilled in the art can achieve the desired result using a single-section boom and a single supply line. For purposes of identification, the two branches of the supply line 23 will be referred to as left (L) and right (R) branches and the four spray devices 2 in FIG. 8 will be referred to as left exterior (LE), left interior (LI), right exterior (RE) and right interior (RI). It will be apparent to the skilled worker that any number of spray devices 2 may be deployed along the boom 17 and that four spray devices 2 are illustrated only for purposes of convenience.

There are provided, as means of controlling the liquid supply pressure, pressure valves 25 in the left and right branches of the supply lines 23. These valves 25 can conveniently be located in the vehicle itself with appropriate means for adjusting them, such as levers, available to the operator.

As was previously mentioned, the actuating pressure and maximum operating pressure of each individual spray device 2 can be selected as desired, for example by selecting the spring 11 (FIG. 5) to have appropriate dimensions and spring constant and positioning the spring 11 in the conduit 5 so as to provide the desired opposing force against the movement of the piston 9.

The range of pressure between the actuating pressure and the maximum operating pressure is referred to as the "operational pressure range" of the particular spray device 2. As illustrative of how swath width can be controlled in accordance with this invention, assume that spray devices LE and RE have operational ranges of 40–80 p.s.i.g. and spray devices LI and RI have operational ranges of 60–100 p.s.i.g. The following table indicates the spray patterns which can be achieved by adjusting the liquid pressure in the right and left branches of the supply line 23.

| Pressure in branch, p.s.i.g. | | Spray devices which are |
|---|---|---|
| L | R | operational (i.e. spraying) |
| 40 | 40 | None |
| 40 | 90 | RI |
| 90 | 40 | LI |
| 90 | 90 | LI, RI |
| 70 | 90 | LE, LI, RI |
| 90 | 70 | LI, RI, RE |
| 70 | 40 | LE, LI |
| 40 | 70 | RE, RI |

-continued

| Pressure in branch, p.s.i.g. | | Spray devices which are |
|---|---|---|
| L | R | operational (i.e. spraying) |
| 50 | 40 | LE |
| 40 | 50 | RE |
| 70 | 70 | All |

The above example is merely illustrative of the swath patterns which can be achieved in accordance with the teachings of this invention. It will be readily apparent to the skilled worker in the art that any number of spray devices 2 having an essentially limitless combination of operational pressure ranges can be deployed, thereby allowing the operator to achieve any desired spray pattern merely by adjusting the liquid supply pressure. By properly positioning the conical body 13 (FIG. 5) to achieve constant liquid flow rate over the operational pressure range, as previously described, one assures that the variations in pressure which are employed to vary swath width will not affect the rate of liquid discharge from the devices.

What is claimed is:

1. A spray device for use on a moving vehicle comprising:

(A) a central body having a conduit defined in said body, said conduit forming a liquid inlet port at one end of the central body, and a plurality of liquid outlet ports located about the periphery of said conduit;

(B) a plurality of discharge tubes extending outwardly from said central body, each of said discharge tubes having one end connected to one of said outlet ports and the other end projecting in a direction opposite the direction of movement of the vehicle during use; and (C) moveable, pressure-actuated outlet-blocking means positioned in said conduit, said outlet-blocking means being positioned to interrupt communication between said conduit and said outlet ports when the liquid pressure in the conduit is below a predetermined actuating pressure and being positioned to allow communication between said conduit and said outlet ports when the liquid pressure in the conduit is above a predetermined actuating pressure, wherein said outlet-blocking means comprises: a piston which is moveable in said conduit, said piston being positioned in said conduit such that it is normally in a position in which it blocks communication between said conduit and said outlet ports and is capable of being moved into a non-blocking position by the action of liquid pressure in the conduit acting against said piston in a direction opposite the direction in which the piston is moved by the action of said liquid pressure, said opposing force being of sufficient magnitude to cause said piston to move into a blocking position whenever the liquid pressure in the conduit is below the predetermined actuating pressure, and wherein said piston is cylindrical in configuration and said conduit is cylindrical in configuration for at least that portion of its length along which the piston travels in moving from the outlet-blocking position to the non-blocking position and wherein the end section of each discharge tube nearest the outlet port extends along a line which is radial from the cylindrical axis of said conduit and the middle section of the discharge tube is curved so that the other end section projects along a line essentially parallel to said cylindrical axis in a direction opposite the direction in which the vehicle moves during use, and wherein said piston is hollowed out along a portion of its axial length to form an annular section, said piston being made of a polymeric material which is capable of undergoing cold flow under pressure, and wherein said device further comprises a diametrically expandable spring securely positioned inside the annular section of said piston, the bias of said spring exerting an outward force on the annulus walls, causing a liquid seal to be maintained between the piston and the conduit wall after the piston has undergone wear.

2. A spray device as claimed in claim 1, wherein said piston is made of polytetrafluorethylene.

3. A spray device for use on a moving vehicle comprising:

(A) a central body having a conduit defined in said body, said conduit forming a liquid inlet port at one end of the central body, and a plurality of liquid outlet ports located about the periphery of said conduit;

(B) a plurality of discharge tubes extending outwardly from said central body, each of said discharge tubes having one end connected to one of said outlet ports and the other end projecting in a direction opposite the direction of movement of the vehicle during use; and (C) moveable, pressure-actuated outlet-blocking means positioned in said conduit, said outlet-blocking means being positioned to interrupt communication between said conduit and said outlet ports when the liquid pressure in the conduit is below a predetermined actuating pressure and being positioned to allow communication between said conduit and said outlet ports when the liquid pressure in the conduit is above a predetermined actuating pressure, wherein said outlet-blocking means comprises: a piston which is moveable in said conduit, said piston being positioned in said conduit such that it is normally in a position in which it blocks communication between said conduit and said outlet ports and is capable of being moved into a non-blocking position by the action of liquid pressure in the conduit acting against said piston in a direction opposite the direction in which the piston is moved by the action of said liquid pressure, said opposing force being of sufficient magnitude to cause said piston to move into a blocking position whenever the liquid pressure in the conduit is below the predetermined actuating pressure, and further comprising, as a flow rate controller, moveable means for obstructing a portion of the cross-sectional area of said inlet port, the movement of said means being coordinated with the movement of said piston so that increased liquid pressure in the conduit is accompanied by obstruction of an increased cross-sectional area of said inlet port and decreased liquid pressure in the conduit is accompanied by obstruction of a decreased cross-sectional area of said inlet port, wherein said moveable means for obstructing a cross-section of said inlet port comprises a conical body located in proximal relationship to the inlet port with the apex of said conical body projecting toward said inlet port, said conical body being attached in fixed relationship to said piston so that movement of the piston caused by changes in liquid pressure in the conduit is accompanied by movement of the conical body, thereby varying the cross-sectional area of the inlet port which is obstructed and varying the rate of liquid flow through said inlet port.

4. A spray device as claimed in claim 3, wherein said conical body is positioned so that it blocks the entire cross-sectional area of the inlet port, thereby stopping the flow of liquid, when the liquid pressure in the conduit is equal or greater than a predetermined maximum operating pressure.

5. A spray device as claimed in claim 4, wherein said conical body is positioned with respect to said piston such that an increase in liquid pressure in the conduit results in a compensating increase in the cross-sectional area of the inlet port which is obstructed by the conical body so that the liquid flow rate remains constant, regardless of liquid pressure, between the actuating pressure and the maximum operating pressure.

6. An apparatus for spraying a variable swath width from a moving vehicle comprising:

(A) a plurality of spray devices as claimed in claim 4, each of said devices having a predetermined actuating pressure and a predetermined maximum operating pressure, said spray devices being affixed to the vehicle at progressively greater lateral distances from the center of the vehicle;

(B) means for supplying liquid under pressure to said spray devices through the inlet ports thereof; and (C) means for controlling the pressure at which the liquid is supplied to said spray devices, the predetermined actuating pressure and maximum operating pressure of each spray device being such that the operator can stop or start the flow of liquid through one or more of said spray devices, thereby regulating the swath width sprayed, by adjusting the pressure at which the liquid is supplied to said devices.

* * * * *

UNITED STATES PATENT AND TRADEMARK OFFICE

CERTIFICATE OF CORRECTION

PATENT NO. : 4,231,520

DATED : November 4, 1980

INVENTOR(S) : John E. Waldrum

It is certified that error appears in the above—identified patent and that said Letters Patent is hereby corrected as shown below:

Column 5, line 6, insert after "the" and before "flow" -- conical body -- .

On the title page Item [73] should read:

-- Union Carbide Corporation, New York, N. Y. --

Signed and Sealed this

*Fourteenth* Day of *July 1981*

[SEAL]

*Attest:*

GERALD J. MOSSINGHOFF

*Attesting Officer*

*Commissioner of Patents and Trademarks*